US006770411B2

(12) United States Patent
Masuda et al.

(10) Patent No.: US 6,770,411 B2
(45) Date of Patent: Aug. 3, 2004

(54) NEGATIVELY CHARGEABLE TONER

(75) Inventors: Minoru Masuda, Numazu (JP); Satoshi Mochizuki, Numazu (JP); Yasuo Asahina, Numazu (JP); Kazuhiko Umemura, Shizuoka-ken (JP); Hideki Sugiura, Fuji (JP); Kohsuke Suzuki, Numazu (JP); Tomomi Tamura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/107,157

(22) Filed: Mar. 28, 2002

(65) Prior Publication Data

US 2002/0182526 A1 Dec. 5, 2002

(30) Foreign Application Priority Data

Mar. 29, 2001 (JP) ..... 2001-095328

(51) Int. Cl.[7] ..... G03G 9/097

(52) U.S. Cl. ..... 430/108.3; 430/137.1; 430/137.15

(58) Field of Search ..... 430/108.3, 137.1, 430/137.15

(56) References Cited

U.S. PATENT DOCUMENTS 5,990,332 A * 11/1999 Sukata et al. ..... 430/110
6,258,502 B1 7/2001 Nakamura et al.
6,326,113 B1 * 12/2001 Okuda et al. ..... 430/108.21
6,363,229 B1 3/2002 Shiraishi et al.
6,368,765 B2 4/2002 Izu et al.
6,406,826 B1 6/2002 Suzuki et al.
6,447,973 B1 9/2002 Asami et al.
6,468,706 B2 10/2002 Matsuda et al.
6,503,681 B2 1/2003 Makino et al.

FOREIGN PATENT DOCUMENTS

EP 0 761 638 A1 3/1997
EP 1 061 420 A2 12/2000

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner including a binder resin, a colorant, and a product of an iron compound containing an aromatic hydroxylcarboxylic acid as a ligand and represented by the formula (I) described in the specification, wherein the product has such a characteristic that a filtrate obtained by filtering a dispersion of 10 g of the product dispersed in 200 ml of purified water provides an electric conductivity of not greater than 600 $\mu$S/cm.

9 Claims, 1 Drawing Sheet

NEGATIVELY CHARGEABLE TONER

BACKGROUND OF THE INVENTION

The present invention relates to a toner for use in an image forming machine such as an electrophotographic recording machine or an electrostatic recording apparatus, and, more particularly, to a toner which is excellent in chargeability, charge rising properties and environmental stability.

In general, a toner used in an electrophotographic copying machine or an electrostatic recording apparatus comprises a binder resin, a colorant, a charge controlling agent and other additives. For the purpose of imparting desired charging characteristics, temporal stability and environmental stability to a toner, various charge controlling agents have been proposed. Examples of such charge controlling agents include a 2:1 type metal complex dye of an azo dye, a metal complex compound of a salicylic acid derivative (disclosed in Japanese Examined Patent Publication No. S55-42752, Japanese Laid-Open Patent Publication No. S61-69073, Japanese Laid-Open Patent Publication No. S61-221756, Japanese Laid-Open Patent Publication No. H09-124659 and so on) a metal salt compound of an aromatic dicarboxylic acid (disclosed in Japanese Laid-Open Patent Publication No. S57-111541, Japanese Laid-Open Patent Publication No. H07-295298 and so on), a metal complex compound of an anthranilic acid derivative (disclosed in Japanese Laid-Open Patent Publication No. S62-94856 and so on), and an organic boron compound (disclosed in Japanese Examined Patent Publication No. H07-31421, Japanese Examined Patent Publication No. H07-104620 and so on).

Those charge controlling agents, however, are heavy metal compounds the use of which is expected to cause environmental concerns or have drawbacks such as insufficient charge imparting properties, insufficient environmental stability and insufficient charge rising properties, so that none of those have satisfactory properties as a charge controlling agent.

SUMMARY OF THE INVENTION

The present invention has been made in view of the prior arts and it is, therefore, an object of the present invention to provide a toner which contains a charge controlling agent free from a heavy metal that may cause environmental concerns, and which is excellent in chargeability, charge rising properties and environmental fluctuation resistance.

In accordance with one aspect of the present invention, there is provided a toner comprising at least a binder resin, a colorant, and a product of an iron compound containing an aromatic hydroxylcarboxylic acid as a ligand and represented by the following formula (I):

(I)

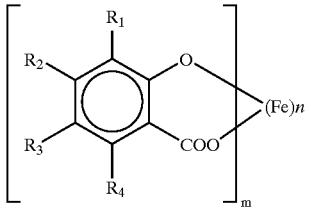

wherein $R_1$, $R_2$, $R_3$, and $R_4$ are independently selected from the group consisting of a hydrogen atom, a straight-chain alkyl group and a branched unsaturated alkyl group, and $R_1$ and $R_2$, $R_2$ and $R_3$, or $R_3$ and $R_4$ may define an aromatic ring which is fused to the benzene ring of the formula (I) and which may have a substituent, m is an integer at least 3 and n is an integer at least 2, said product having such a characteristic that a filtrate obtained by filtering a dispersion of 10 g of said product dispersed in 200 ml of purified water provides an electric conductivity of not greater than 600 $\mu$S/cm.

In another aspect, the present invention provides a method of preparing a toner, comprising the steps of:

providing a product of an aromatic hydroxylcarboxylic acid ligand-containing iron compound represented by the following formula (I):

(I)

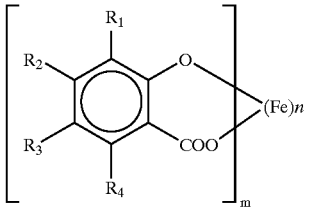

wherein $R_1$, $R_2$, $R_3$, and $R_4$ are independently selected from the group consisting of a hydrogen atom, a straight-chain alkyl group and a branched unsaturated alkyl group, and $R_1$ and $R_2$, $R_2$ and $R_3$, or $R_3$ and $R_4$ may define an aromatic ring which is fused to the benzene ring of the formula (I) and which may have a substituent, m is an integer at least 3 and n is an integer at least 2, purifying said product to obtain a purified iron compound of the formula (I) having such a characteristic that a filtrate obtained by filtering a dispersion of 10 g of said purified iron compound dispersed in 200 ml of purified water provides an electric conductivity of not greater than 600 $\mu$S/cm, kneading said purified iron compound with a binder resin and a colorant, and pulverizing said kneaded mixture into powder.

BRIEF DESCRIPTION OF THE DRAWING

Other objects, features and advantages of the present invention will become apparent from the detailed description of the preferred embodiments of the invention which follows, when considered in the light of the accompanying drawing, in which.

DETAILED DESCRIPTION OF THE PREFERRED EMBODIMENTS OF THE INVENTION

Figure 1:
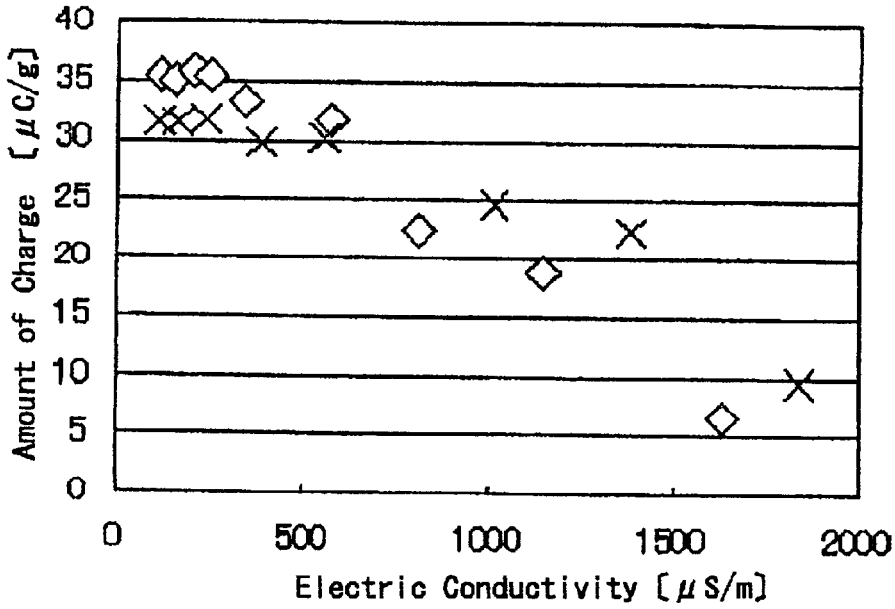
FIG. 1 is a graph showing the relationship between static charge amount of toner and electric conductivity of filtrate in the present invention.

Description will be made of the preferred embodiments of the present invention.

A toner of the present invention contains a compound containing an aromatic hydroxylcarboxylic acid as a ligand and represented by the above formula (I) as a charge controlling agent. The compound may be used in combination with another charge controlling agent to enhance the chargeability of the toner. The compound will be hereinafter referred to as "subject charge controlling agent".

When the subject charge controlling agent is used, a desirable developer can be obtained which is excellent in charge rising properties, which can secures a high charge level and which hardly generates reversely-charged developer. Thus, a high-quality image with a high image density and little background staining (background fogging) can be produced.

The present invention is characterized in that the subject charge controlling agent has such a characteristic that a filtrate of a dispersion of 10 g of the subject charge controlling agent dispersed in 200 ml of purified water provides an electric conductivity of not greater than 600 $\mu$S/cm. The electric conductivity is preferably not greater than 250 $\mu$S/cm. The subject charge controlling agent is an iron compound represented by the above formula (I) and is industrially produced by a method in which iron (II) chloride (ferrous chloride) or iron (III) chloride (ferric chloride) is reacted with a salicylic acid compound in the presence of sodium hydroxide.

It has been found that a commercially available product of the iron compound of the above formula (I) is not suitable as such for use as a charge controlling agent for a toner with respect to charge imparting properties, environmental stability and charge rising properties. It has also been found that the above problems of the commercially product are attributed to soluble salts such as sodium chloride contained in the commercially product. The present invention is based on the above findings.

By purifying the commercial product by, for example, washing with water, the undesirable salt contained therein can be removed.

Although not wishing to be bound by the theory, the mechanism by which the improvement of charging characteristics of the subject charge controlling agent is attained is considered as follows. The subject charge controlling agent provides a toner with a negative charge. Namely, the subject controlling agent captures and holds electrons by friction and so on. It is thought that a charge controlling agent which provides a large electric conductivity when dispersed in purified water is poor in the function of capturing and holding electrons because it contains substances which are easily ionized. Further, such a charge controlling agent is considered to absorb water and to cause a large decrease in the static charge amount of the toner when left under a humid environment because of impurity substances which are easily ionized with the aid of water.

A specific method of measuring the electric conductivity of a filtrate of a dispersion of 10 g of the subject charge control agent dispersed in 200 ml of purified water is as follows.

10 Grams of the subject charge controlling agent is charged in a 500 ml beaker. 200 Ml of purified water such as ion-exchanged water is measured. The purified water is gradually added to the subject charge controlling agent. The mixture is weighed and boiled well for ten minutes. On cooling in a cooling bath, purified water is added to the mixture until the weight of the mixture reaches to the original weight. The mixture is stirred well and filtered using a filter paper, No. 2, made by Toyo Roshi Kaisha, Ltd. Then, the electric conductivity of the filtrate is measured with an electric conductivity meter.

The subject charge controlling agent may be used in any amount depending upon a system in which the resulting toner is used, but it is preferably used in an amount of 0.5-10% by weight, more preferably 1-5% by weight based on a total weight of the toner. By the addition of the subject charge controlling agent in such an amount, sufficient chargeability for use in practice can be imparted to the toner without excessively increasing the cost.

As for other ingredients of the toner of the present invention, any toner ingredients generally used in the field of toners for use in an image forming method such as electrophotography may be used for the purpose of the present invention.

Illustrative of suitable binder resins are homopolymers of styrene or its homologues such as polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These polymers can be used alone or in combination.

As the colorant usable in the present invention, any colorant known to be used conventionally for the preparation of a toner can be employed. However, the subject charge controlling agent, which is black or grey in color, is not suitable for a full-color toner but preferably used in a black toner or a mono-color toner. Suitable colorants for use in the toner of the present invention are carbon black, Nigrosine dyes, iron black, iron oxide and mixtures thereof. The colorant is generally used in an amount of 0.1-50 parts by weight per 100 parts of the binder resin.

The toner of the present invention may contain another charge controlling agent in addition to the subject charge controlling agent for enhancing the chargeability thereof, if desired. Any charge controlling agent generally used in the field of toners for use in electrophotography may be used for the purpose. Examples of such additional charge controllingling agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metal salts of salicylic acid and derivatives thereof.

Specific examples of the additional charge controlling agents include Bontron 03 (Nigrosine dyes), Bontron P-51 (Quaternary ammonium salts), Bontron S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; Copy Charge PSY VP2038 (quaternary ammonium salts)' Copy Blue PR (triphenylmethane derivatives), Copy Charge NEG VP2036 (quaternary ammonium salts) and Copy Charge NX VP434(quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

The amount of the additional charge controlling agent used for enhancing the chargeability use in the color toner may be determined in light of the amount of the subject charge controlling agent, the kind of binder resin to be employed, the presence or absence of additives, and the preparation method of the toner including the method of dispersing the composition of the toner. It is preferable that the amount of the additional charge controlling agent be in the range of 0.1 to 10 parts by weight, and more preferably in the range of 0.3 to 5 parts by weight, per 100 parts by weight of the binder resin. By the addition of the additional charge controlling agent in such an amount, sufficient chargeability for use in practice can be imparted to the toner. Further, electrostatic attraction of the toner to a developing roller can be prevented, so that the decrease of fluidity of the developer and the decrease of image density can be prevented.

The toner of the present invention may contain a wax so that the toner may have a releasing property. The wax used in the present invention generally has a melting point of 40-120° C., preferably 50-110° C. Too high a melting point of wax may adversely affect the low-temperature fixability of the toner, while too low a melting point may adversely affect the offset resistance and preservability of the toner. The melting point of the wax can be measured by a differential scanning calorimetry (DSC). Namely, the melting peak temperature obtained by heating a few mg of a sample at a given rate, 10° C./min, for example, is employed as the melting point of the wax.

Illustrative of suitable waxes are a solid polyolefin wax, a microcrystalline wax, rice wax, a fatty acid amide wax, a fatty acid wax, aliphatic monoketones, a fatty acid metal salt wax, a fatty acid ester wax, a partially-saponified fatty acid ester wax, a silicone varnish, higher alcohols, and carnauba wax. A polyolefin such as low-molecular weight polyethylene or polypropylene can be also used. Especially, the use of polylefin having a softening point as measured according to a ring and ball method of 70-150° C., preferably 120-150° C. is preferred.

Inorganic fine particles may be suitably used as an external additive. Such inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 mμ (5 nm) to 2 μm, more preferably 5 mμ to 500 mμ, and a BET specific surface area of 20-500 $m^2/g$. The inorganic fine particles are used in an amount of generally 0.01-5% by weight, preferably 0.01-2% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, and aluminum type coupling agents.

Cleaning property improving agents may be also used in the toner of the present invention for facilitating the removal of toner remaining on a photoconductor or an intermediate transfer medium after the transference. Examples of such cleaning property improving agents include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The particulate polymer preferably has a volume average particle diameter of 0.01-1 μm.

A toner according to the present invention may be prepared as follows.

First, ingredients of the toner such as a binder resin, a coloring agent, wax and a charge controlling agent are mechanically mixed with each other using a suitable mixer to obtain a mixture. The mixture is then kneaded using a suitable kneader. The kneaded mixture is then solidified and the solidified mixture is finely ground using a suitable grinder. The ground particles are classified using a suitable classifier to obtain a toner having a desired average particle size.

The thus obtained toner is, if desired, mixed with an external additive such as a fluidizing agent to improve the fluidity, preservability, developing efficiency and transfer efficiency.

The following examples will further describe the present invention but are not intended to limit the present invention. Parts are by weight.

Preparation Example 1

0.485 Kg of ferric chloride was dissolved in 15 liters of water at 60° C. 1.875 Kg of 3,5-di-tert-butylsalicylic acid and 0.36 kg of sodium hydroxide were dissolved in 20 liters of water at 60° C. The latter solution was added dropwise to the former solution. The mixed solution was reacted at 95° C. The thus produced precipitates were filtered, dried and ground, thereby obtaining a dingy powder (1). The powder (1) was washed with water and an alcohol with varying washing intensity, thereby obtaining charge controlling agents 1-1 to 1-9. 10 Grams of each of the charge controlling agents 1-1 to 1-9 was dissolved in 200 ml of purified water and the solution was filtered. The thus obtained filtrates had electric conductivities of 123, 154, 208, 248, 344, 578, 814, 1,150 and 1,632 μS/cm, respectively.

Preparation Example 2

0.485 Kg of ferric chloride was dissolved in 15 liters of water at 60° C. 2.150 Kg of 5-tert-octylsalicylic acid and 0.36 kg of sodium hydroxide were dissolved in 20 liters of water at 60° C. The latter solution was added dropwise to the former solution. The mixed solution was reacted at 95° C. The thus produced precipitates were filtered, dried and ground, thereby obtaining a dingy powder (2). The powder (2) was washed with water and an alcohol with varying washing intensity, thereby obtaining charge controlling agents 2-1 to 2-8. 10 Grams of each of the charge controlling agents 2-1 to 2-8 was dispersed in 200 ml of purified water and the dispersion was filtered. The thus obtained filtrates had electric conductivities of 113, 165, 238, 387, 558, 1014, 1384, 1839 μS/cm, respectively.

Using each of the thus obtained charge controlling agents, a toner was prepared in the following manner.

| | |
|---|---|
| Polyester resin | 100 parts |
| Carbon black | 6 parts |
| Charge controlling agent | 2 parts |
| Carnauba wax | 1 part |

The above ingredients were mixed in a mixer and then melt-kneaded in a double-roll mixer. The kneaded mixture was rolled and cooled, followed by grinding with a collision board type jet mill grinder (I Type Mill, manufactured by Nippon Pneumatic Mfg. Co. Ltd.) and air-classification with a vortex classifier (DS Classifier, manufactured by Nippon Pneumatic Mfg. Co. Ltd.), thereby obtaining a toner having a volume average particle size of 8 μm. The toner was mixed with an iron powder using a roll mill and measured for the static charge amount by a blow-off method. The results are summarized in Tables 1 and 2 and in FIG. 1. In FIG. 1, the plots indicated by the white squares are the results of toners containing charge controlling agents 1-1 through 1-9, while the plots indicated by the crosses are the results of toners containing charge controlling agents 2-1 through 2-8.

The following test was also conducted to evaluate the quality of an image printed using a laser printer.

0.5% By weight of a hydrophobic silica (H2000, made by Clariant Japan) was added to the toner. The mixture was mixed in a mixer to obtain a developer having a high fluidity. The thus obtained developer was charged in a laser printer, IPSIO COLOR 8000, manufactured by Ricoh Company, Ltd. and an image was printed out. The background fogging and toner scattering of the printed image was evaluated. The evaluation of background fogging was conducted according to the following three levels:

A: Good

B: Fair

C: No good

The results are shown in Tables 1 and 2.

TABLE 1

Test Results of Preparation Example 1

| Charge controlling agent | Electric conductivity [μS/cm] | Static charge amount of toner [μC/g] | Evaluation of background fogging |
|---|---|---|---|
| 1-1 | 123 | 35.4 | A |
| 1-2 | 154 | 35.1 | A |
| 1-3 | 208 | 35.8 | A |
| 1-4 | 248 | 35.5 | A |
| 1-5 | 344 | 33.2 | A |
| 1-6 | 578 | 31.7 | A |
| 1-7 | 814 | 22.3 | B |
| 1-8 | 1150 | 18.8 | C |
| 1-9 | 1632 | 6.5 | C |

TABLE 2

Test Results of Preparation Example 2

| Charge controlling agent | Electric conductivity [μS/cm] | Static charge amount of toner [μC/g] | Evaluation of background fogging |
|---|---|---|---|
| 2-1 | 113 | 31.5 | A |
| 2-2 | 165 | 31.4 | A |
| 2-3 | 238 | 31.7 | A |
| 2-4 | 387 | 29.8 | A |
| 2-5 | 558 | 30.2 | A |
| 2-6 | 1014 | 24.5 | B |
| 2-7 | 1384 | 22.3 | B |
| 2-8 | 1839 | 9.5 | C |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A toner comprising at least a binder resin, a colorant, and a product of an iron compound containing an aromatic hydroxylcarboxylic acid as a ligand and represented by the following formula (I):

(I)

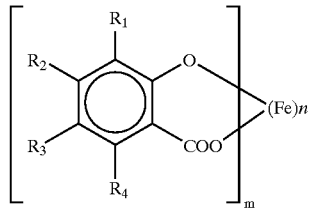

wherein $R_1$, $R_2$, $R_3$, and $R_4$ are independently selected from the group consisting of a hydrogen atom, a straight-chain alkyl group and a branched unsaturated alkyl group, and $R_1$ and $R_2$, $R_2$ and $R_3$, or $R_3$ and $R_4$ may define an aromatic ring which is fused to the benzene ring of the formula (I) and which may have a substituent, m is an integer at least 3 and n is an integer at least 2, said product having such a characteristic that a filtrate obtained by filtering a dispersion of 10 g of said product dispersed in 200 ml of purified water provides an electric conductivity of not greater than 600 μS/cm.

2. A negatively chargeable toner as claimed in claim 1, wherein said iron compound of the formula (I) is present in an amount of 0.5–10% by weight based on the weight of the toner.

3. A method of preparing a toner, comprising the steps of:

providing a product of an aromatic hydroxylcarboxylic acid ligand-containing iron compound represented by the following formula (I):

(I)

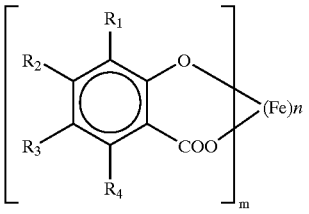

wherein $R_1$, $R_2$, $R_3$, and $R_4$ are independently selected from the group consisting of a hydrogen atom, a straight-chain alkyl group and a branched unsaturated alkyl group, and $R_1$ and $R_2$, $R_2$ and $R_3$, or $R_3$ and $R_4$ may define an aromatic ring which is fused to the benzene ring of the formula (I) and which may have a substituent, m is an integer at least 3 and n is an integer at least 2, purifying said product to obtain a purified iron compound of the formula (I) having such a characteristic that a filtrate obtained by filtering a dispersion of 10 g of said purified iron compound dispersed in 200 ml of purified water provides an electric conductivity of not greater than 600 $\mu$S/cm, kneading said purified iron compound with a binder resin and a colorant, and pulverizing said kneaded mixture into powder.

4. A toner obtained by a method according to claim 3.

5. A negatively chargeable toner as claimed in claim 1, wherein the electric conductivity is not greater then 250 $\mu$S/cm.

6. A negatively chargeable toner as claimed in claim 2, wherein said amount is 1–5% by weight.

7. A negatively chargeable toner as claimed in claim 1, wherein said product has been treated by removing soluble salts therefrom.

8. A method comprising electrophotographic copying using the toner according to claim 1.

9. A method comprising electrostatic recording using the toner of claim 1.

* * * * *